US007191633B1

(12) United States Patent
Uehara et al.

(10) Patent No.: US 7,191,633 B1
(45) Date of Patent: Mar. 20, 2007

(54) FORGING APPARATUS

(75) Inventors: Yoichi Uehara, Fujimino (JP); Takashi Kihara, Tochigi-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/284,029

(22) Filed: Nov. 22, 2005

(51) Int. Cl.
*B21K 13/02* (2006.01)

(52) U.S. Cl. ..... 72/355.4; 72/355.6

(58) Field of Classification Search ..... 72/352, 72/352.2, 353.2, 354.2
See application file for complete search history.

(56) References Cited

U.S. PATENT DOCUMENTS 4,847,968 A * 7/1989 Shirai et al. ..... 29/892
5,894,752 A * 4/1999 Yano et al. ..... 72/355.6

FOREIGN PATENT DOCUMENTS

JP 47-15629 10/1972
JP 51-63069 A 6/1976
JP 60-115342 6/1985
JP 03-005039 A 1/1991

* cited by examiner

*Primary Examiner*—Lowell A. Larson
*Assistant Examiner*—Debra Wolfe
(74) *Attorney, Agent, or Firm*—Arent Fox PLLC

(57) ABSTRACT

A forging apparatus has an upper die unit connected to an actuator for displacement in unison therewith, and a lower die unit confronting the upper die unit and mounted in a body assembly fixed to a foundation. An outer ring is guided axially by a plurality of guide pins for axial displacement on and along an outer circumferential surface of the lower die unit. The forging apparatus also has first ejector pins for removing a forged workpiece upwardly and second ejector pins for holding the workpiece when the upper die unit is displaced upwardly.

19 Claims, 8 Drawing Sheets

FORGING APPARATUS

BACKGROUND OF THE INVENTION

1. Field of the Invention

The present invention relates to a forging apparatus, and more particularly to a forging apparatus for allowing a forged workpiece to be removed without the need for a draft angle.

2. Description of the Related Art

There has heretofore been known in the art a forging apparatus for forging a blank into a workpiece of given shape by placing the blank into a die cavity and pressing the blank with a press or the like (see, for example, Japanese Laid-Open Patent Publication No. 60-115342).

The forging apparatus has a die assembly comprising an upper die and a lower die which are vertically separable from each other and which, when put together, create a die cavity that is complementary in shape to the desired workpiece. In operation, the blank is placed on the upper surface of the lower die, and then the upper die is pressed against the blank by the press. When the blank is pressed between the upper and lower dies, the material of the blank flows and the blank is plastically deformed into a predetermined shape along the inner wall surfaces of the die assembly, thus producing the desired workpiece. Since the workpiece is forged under an intensive pressure by the press, strong pressing forces are applied from the contacting surfaces of the workpiece to the inner wall surfaces of the die assembly when the workpiece is forged.

When the forged workpiece is removed from the die assembly, it is difficult to separate the workpiece from the die assembly because of frictional forces generated between the inner wall surfaces of the die assembly and the forged workpiece. Generally, inner wall surfaces of the die assembly which extend substantially parallel to the direction in which the workpiece is pressed by the press have a draft angle, i.e., a taper, such that the inner wall surfaces are inclined at a certain angle so as to spread progressively in the direction in which the forged workpiece is to be pushed out or removed. Because of the draft angle of the die assembly, the forged workpiece also has a complementary draft angle which allows the workpiece to be easily removed out of the die assembly when the workpiece is pushed axially along the direction in which the inner wall surfaces spread progressively. The forged workpiece is formed to a size that is greater than the desired shape by the draft angle, and hence the blank from which the workpiece is forged is also of a greater size.

Since the draft angle on the workpiece is provided solely for the purpose of removing the workpiece from the die assembly, it is not a required intrinsic shape of the workpiece. Therefore, after the forged workpiece is removed from the die assembly, the workpiece is machined, e.g., ground, to flatten the draft angle into straight surfaces parallel to the axis of the workpiece, thereby achieving the intrinsic shape of the workpiece.

Inasmuch as the workpiece is subsequently machined, the workpiece needs to have a machining allowance for subsequent machining in the vicinity of the draft angle. Therefore, the workpiece is forged to a size including the machining allowance for subsequent machining.

The conventional forging apparatus has the draft angle for easy removal of the forged workpiece from the die assembly, and the forged workpiece is subsequently machined into the desired final shape separately from the forging process.

Consequently, the process of manufacturing the workpiece comprises an increased number of steps, and hence is costly to perform.

In addition, as the workpiece has the draft angle and also needs to have the machining allowance in the vicinity of the draft angle, the amount of material of the blank to be forged into the workpiece is greater than required compared with the final intrinsic shape of the workpiece, resulting in an increase in the cost of the workpiece.

If the inner wall surfaces of the die assembly do not have a draft angle, but are straight surfaces, then the workpiece that is forged by the die assembly cannot easily be removed from the die assembly because of frictional forces generated between the inner wall surfaces of the die assembly and the forged workpiece.

SUMMARY OF THE INVENTION

It is a general object of the present invention to provide a forging apparatus which allows a forged workpiece to be removed from a die assembly easily without the need for a draft angle on inner wall surfaces of the die assembly.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
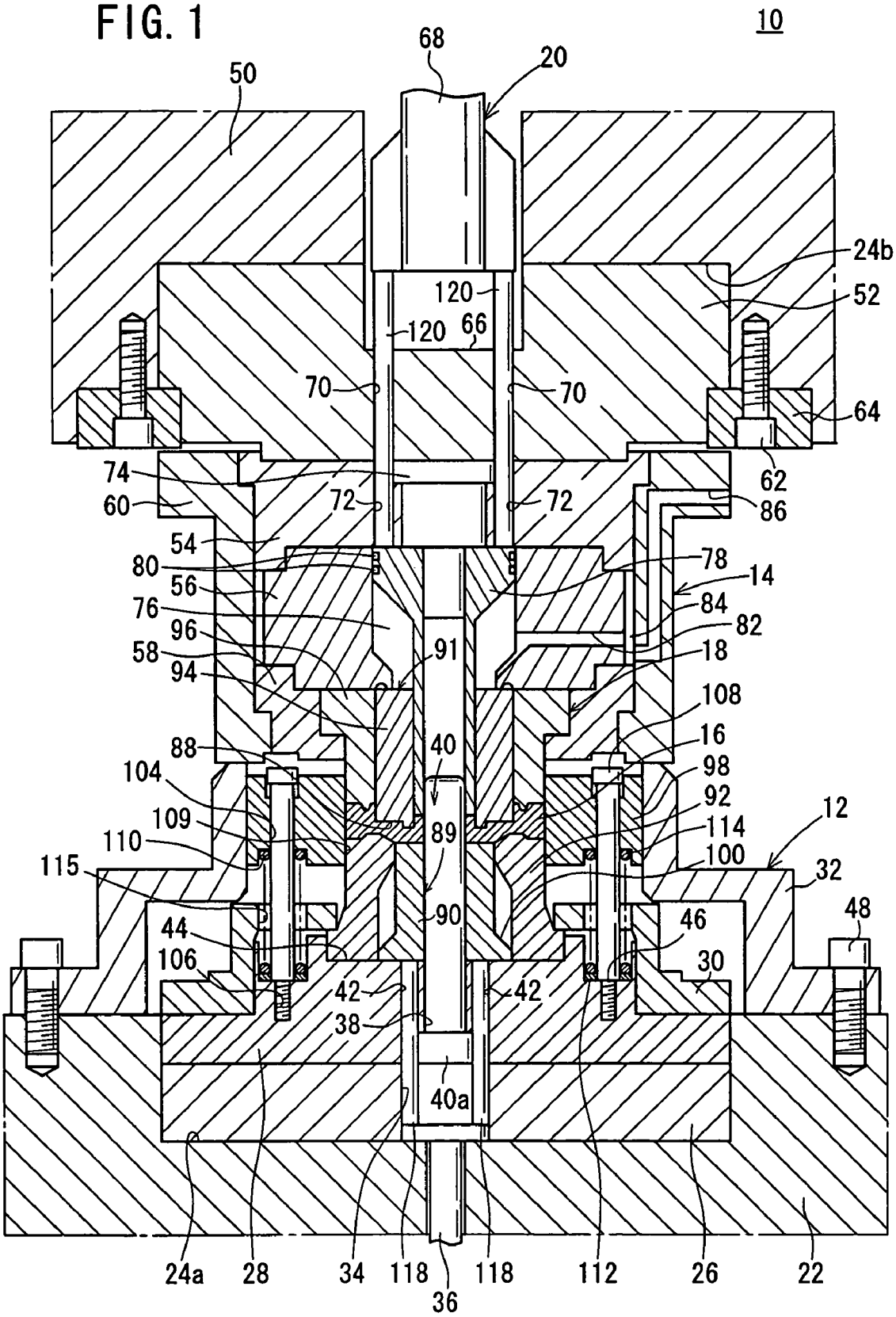
FIG. 1 is a vertical cross-sectional view of a forging apparatus according to an embodiment of the present invention.

FIG. 1 shows a forging apparatus 10 according to an embodiment of the present invention. The terms "axis", "axial", and "axially" referred to herein are used in reference to a vertical axis of the forging apparatus 10 shown in FIG. 1.

As shown in FIG. 1, the forging apparatus 10 comprises a body assembly 12, an actuator 14 for actuating a portion of the body assembly 12 in an axial direction thereof, a die assembly 18 for placing a workpiece 16 to be forged therein, and a workpiece ejecting mechanism (workpiece removing mechanism) 20 disposed vertically along the axial direction of the body assembly 12.

The body assembly 12 has a plate-like first base 26 mounted in a recess 24*a* in a foundation 22, a second base 28 mounted on the first base 26, and first and second fixing members 30, 32 by which the second base 28 is integrally fixed to the foundation 22.

The first base 26 has a first through hole 34 defined substantially centrally therein and extending along the axial direction of the body assembly 12. A first shaft 36 is vertically movably supported in the foundation 22 in alignment with the first through hole 34, and is movable upwardly into the first through hole 34. The second base 28 has a second through hole 38, which has a slightly smaller diameter than that of the first through hole 34, defined substantially centrally therein in axial alignment and communication with the first through hole 34. An elongate guide shaft 40 which extends upwardly from the first base 26 is inserted in the second through hole 38.

The guide shaft 40 has a radially outwardly enlarged flange 40*a* on its lower end. The radially outwardly enlarged flange 40*a* has an outer diameter greater than the inner diameter of the second through hole 38, and hence is engaged by the lower end of the second through hole 38. The radially outwardly enlarged flange 40*a* has a lower surface substantially in flush with the lower surface of the second base 28. The guide shaft 40 is fixed in position by the radially outwardly enlarged flange 40*a* which is engaged between the upper surface of the first base 26 and the second base 28.

The second base 28 also has a plurality of first insertion holes 42 defined therein which are spaced radially outwardly from the second through hole 38 and disposed circumferentially at intervals around the second through hole 38. The first insertion holes 42 communicate with the first through hole 34.

The second base 28 has a mount hole 44 having a predetermined depth defined in an upper surface thereof which faces the die assembly 18. The die assembly 18 is partly inserted in the mount hole 44. A plurality of first spring seats 46 are defined in the second base 28 around the mount hole 44. The first spring seats 46 have a predetermined depth from the upper surface of the second base 28. The first spring seats 46 are disposed at predetermined intervals around the second through hole 38 in the circumferential direction of the second base 28.

The first fixing member 30 covers an outer circumferential portion of the second base 28. The second fixing member 32 is fixed to the foundation 22 by a plurality of bolts 48 around the first fixing member 30. The forging apparatus 10 is fixed to the foundation 22 by the first fixing member 30 and the second fixing member 32.

The actuator 14 comprises a press 50 actuatable by a current supplied from a power supply (not shown) for applying an axial downward pressure, a plate 52 mounted in a recess 24*b* defined in a lower surface of the press 50, first through third connectors 54, 56, 58 successively joined axially to the plate 52, a joint 60 mounted on outer circumferential surfaces of the first through third connectors 54, 56, 58, and a piston 78 displaceable axially under a fluid pressure in the second connector 56.

A ring-shaped attachment 64 is fastened to the lower surface of the press 50 by a plurality of mounting bolts 62. The plate 52 is fixedly mounted in the recess 24*b* by the ring-shaped attachment 64. The plate 52 has a shaft insertion hole 66 defined substantially centrally therein which is open toward the press 50. The plate 52 also has a plurality of second insertion holes 70 defined therein which extend downwardly through the plate 52. The shaft insertion hole 66 and the second insertion holes 70 communicate with each other. A second shaft 68 is inserted from the press 50 into the shaft insertion hole 66 and the second insertion holes 70.

The first connector 54, which is of an annular shape, is fastened to the lower surface of the plate 52 by bolts (not shown), and has a plurality of third insertion holes 72 defined therein in communication with the respective second insertion holes 70. A downwardly projecting guide member 74 engages substantially centrally in the first connector 54 and has an upper surface held against the lower surface of the plate 52. The guide member 74 is fixedly mounted in the first connector 54 against axial displacement.

The second connector 56 is integrally joined to a lower surface of the first connector 54 and has a cylinder chamber 76 defined substantially centrally therein. The piston 78 is axially displaceably disposed in the cylinder chamber 76. The piston 78 has a larger-diameter upper end portion close to the first connector 54 and is of a hollow structure having a substantially constant inside diameter. A lower end portion of the guide member 74 is inserted into the upper end portion of the piston 78, and an upper end portion of the guide shaft 40 is inserted into a lower end portion of the piston 78. Therefore, the piston 78 is axially displaceable while being guided by the lower end portion of the guide member 74 and the upper end portion of the guide shaft 40. The larger-diameter upper end portion of the piston 78 has a plurality of annular grooves defined in an outer circumferential surface thereof and receiving therein respective seal rings 80 for keeping the cylinder chamber 76 hermetically sealed.

The second connector 56 has a communication passage 82 defined therein which extends substantially perpendicularly to the axis of the second connector 56. The communication passage 82 provides fluid communication between the cylinder chamber 76 and a chamber 84 that is defined between the outer circumferential surface of the second connector 56 and the inner circumferential surface of the joint 60.

The third connector 58 is joined to a lower surface of the second connector 56 near the outer circumferential surface of the second connector 56. The joint 60, which is of a substantially hollow cylindrical shape, is joined to the outer circumferential surfaces of the first and third connectors 54, 58 surrounding the outer circumferential surface of the second connector 56. The joint 60 has a fluid passage 86 defined therein which extends from the inner circumferential surface of the joint 60 to the outer circumferential surface of the joint 60. A fluid under pressure is introduced from a fluid pressure source (not shown) through a tube into the fluid passage 86, and supplied from the fluid passage 86 through the chamber 84 and the communication passage 82 into the cylinder chamber 76.

The first through third connectors 54, 56, 58 and the joint 60 are integrally coupled to the press 50 by the plate 52, and function as a portion of the actuator 14 which is displaceable as one piece in the axial direction.

The die assembly 18 is disposed between the second base 28 and the second connector 56 and has a die cavity 88 complementary in shape to a desired forged product such as a transmission gear, for example. The die assembly 18 comprises a lower die unit (second die unit) 89 disposed in the mount hole 44 in the second base 28, an upper die unit (first die unit) 91 disposed on the lower surface of the second connector 56, and an outer ring (displacement member) 98 displaceable along the outer circumferential surface of the lower die unit 89 and the inner circumferential surface of the second fixing member 32.

The lower die unit 89 comprises a first lower die (first die) 90 guided by the guide shaft 40 for axial displacement and a second lower die (second die) 92 disposed adjacent to an outer circumferential surface of the first lower die 90.

The first lower die 90 has a lower end mounted in the mount hole 44. The first shaft 36 has a plurality of first ejector pins 118 extending respectively through the first insertion holes 42 in the second base 28 and having respective upper ends held against a lower surface of the first lower die 90. When the first ejector pins 118 are pushed upwardly, the first lower die 90 is displaced upwardly axially along the guide shaft 40. The first lower die 90 also has, on a lower end portion thereof, a first slanted surface 100 inclined progressively downwardly toward the second lower die 92 and projecting a predetermined distance radially outwardly.

The second lower die 92 is mounted in a radially outer portion of the mount hole 44. The second lower die 92 has an outer circumferential surface engaged by an inner circumferential edge of the first fixing member 30 to keep the second lower die 92 fixed to the second base 28. The second lower die 92 has, on an upper end portion thereof, a second slanted surface 102 inclined progressively upwardly toward the first lower die 90 and projecting a predetermined distance radially inwardly. The first and second lower dies 90, 92 have upper surfaces shaped complementarily to the lower surface of the workpiece 16 that is placed on the upper surfaces of the first and second lower dies 90, 92.

The upper die unit 91 comprises a first upper die 94 held against the piston 78 for axial displacement and a second upper die 96 disposed adjacent to an outer circumferential surface of the first upper die 94. The first and second upper dies 94, 96 have lower surfaces shaped complementarily to the upper surface of the workpiece 16 that is placed in the die cavity 88 below the upper die unit 91.

The first upper die 94 has an upper end joined to the lower surface of the second connector 56 and an inner circumferential surface held against an outer circumferential surface of the piston 78.

The second upper die 96 has an upper end joined to the lower surface of the second connector 56 and an outer circumferential surface held in engagement with the third connector 58. The second upper die 96 has an inner circumferential surface held against the outer circumferential surface of the first upper die 94. The first and second upper dies 94, 96 are displaceable axially in unison with the second and third connectors 56, 58.

The outer ring 98, which is of an annular shape, has a plurality of guide holes 104 defined axially therethrough at circumferentially spaced from each other. Guide pins 108 extend respectively through the guide holes 104 and have respective lower ends threaded into internally threaded holes 106 that are defined in the bottoms of the first spring seats 46, respectively. The outer ring 98 is guided by the guide pins 108 for axial displacement over a predetermined distance. There are as many guide holes 104 as the number of the first spring seats 46 and the number of the guide pins 108.

The outer ring 98 has an inner circumferential surface (inner wall surface) 109 held against the outer circumferential surfaces of the second upper die 96 and the second lower die 92, and an outer circumferential surface held against the inner circumferential surface of the second fixing member 32. The outer ring 98 is axially displaceable while these inner and outer circumferential surfaces are being held against each other. When the workpiece 16 is forged, the inner circumferential surface 109 of the outer ring 98 functions as part of the die assembly 18.

The outer ring 98 has a plurality of second spring seats 110 defined in the lower surface thereof in alignment with the first spring seats 46. The second spring seats 110 have a predetermined depth from the lower surface of the outer ring 98. The second spring seats 110 are disposed at intervals in the circumferential direction of the outer ring 98. There are as many second spring seats 110 as the number of the first spring seats 46 in the second base 28.

Springs 114 are disposed around the respective guide pins 108 between the second spring seats 110 and annular spring washers 112 mounted on the respective bottoms of the first spring seats 46. The springs 114 normally bias the outer ring 98 to be displaced toward the actuator 14. The springs 114 and the guide pins 108 extend through respective holes 115 defined in the first fixing member 30.

The inner circumferential surface 109 of the outer ring 98 has a diameter which is essentially the same as or slightly greater than the diameter of the outer circumferential surface of the second upper die 96. Therefore, the inner circumferential surface 109 of the outer ring 98 does not obstruct downward displacement of the second upper die 96.

The workpiece ejecting mechanism 20 comprises the first shaft 36 extending into the first through hole 34 in the first base 26, the first ejector pins 118 extending upwardly from a radially outwardly enlarged upper end of the first shaft 36, the second shaft 68 inserted in the shaft insertion hole 66 in the plate 52, and a plurality of second ejector pins 120 extending downwardly from a radially outwardly enlarged lower end of the second shaft 68.

The first ejector pins 118 are displaceably inserted into the respective first insertion holes 42 through the first through hole 34. The first ejector pins 118 have respective upper end faces held against the lower surface of the first lower die 90 at all times. The second ejector pins 120 are displaceably inserted into the respective second insertion holes 70 and the respective third insertion holes 72 through the shaft insertion hole 66, and have respective lower end faces held against the upper surface of the piston 78 at all times.

The forging apparatus 10 according to the embodiment of the present invention is basically constructed as described above. Operation and advantages of the forging apparatus 10 will be described below with reference to FIGS. 2 through 8. The position shown in FIG. 2 of the first and second upper dies 94, 96 that are displaced upwardly by the actuator 14 is referred to as an initial position.

Figure 2:
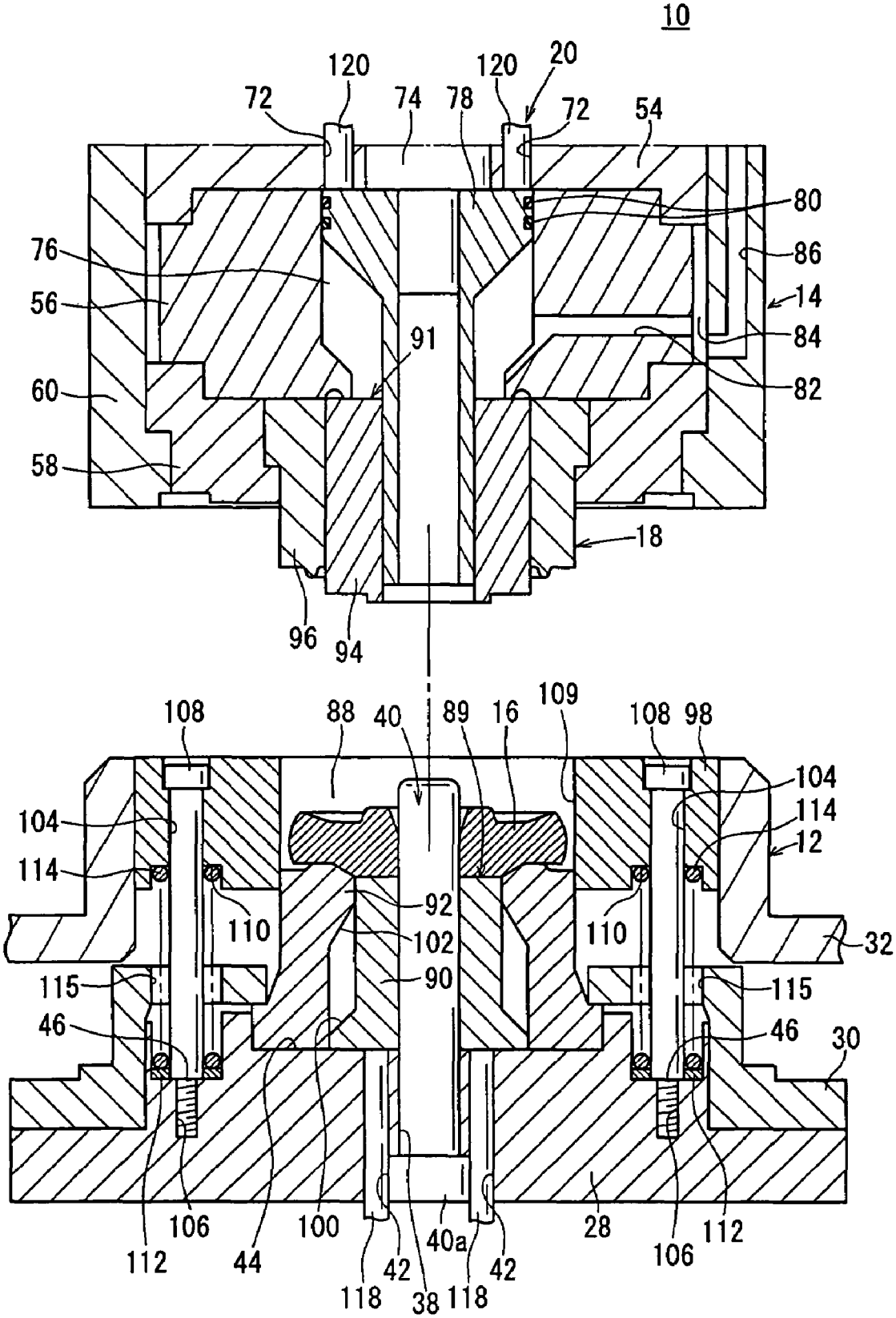
FIG. 2 is a vertical cross-sectional view showing the manner in which an actuator of the forging apparatus is displaced upwardly and a workpiece is placed in a die cavity in the forging apparatus.
Figure 3:
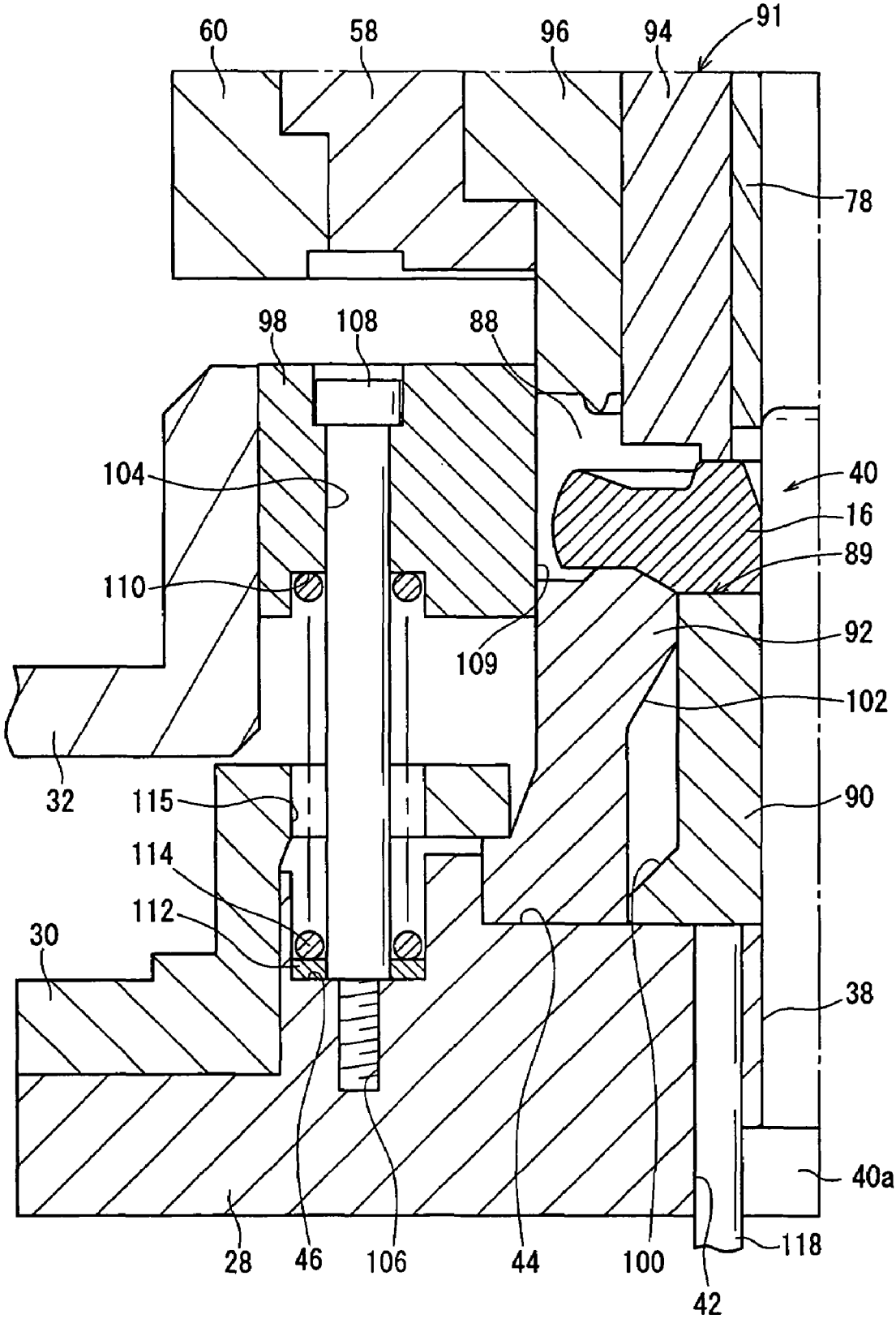
FIG. 3 is an enlarged fragmentary vertical cross-sectional view showing the manner in which a first upper die is held against an upper surface of the workpiece in the forging apparatus.

First, as shown in FIG. 2, a blank to be forged as the workpiece 16 is placed on the upper surfaces of the first and second lower dies 90, 92 in the die cavity 88 when the first and second upper dies 94, 96 are in the initial position. Then, the press 50 (see FIG. 1) is supplied with a current from the non-illustrated power supply to displace the first through third connectors 54, 56, 58, the first and second upper dies 94, 96, the piston 78, and the joint 60 which are joined to the press 50 by the plate 52 (see FIG. 1), downwardly in the axial direction in unison with each other. As the actuator 14 is thus displaced downwardly, the lower end of the first upper die 94 first abuts against the upper surface of the workpiece 16, as shown in FIG. 3.

At this time, the piston 78 is displaced upwardly by a fluid under pressure supplied from the non-illustrated fluid pressure source through the fluid passage 86 and the communication passage 82, and has its upper surface held against the lower surface of the first connector 54 (see FIG. 2).

Figure 4:
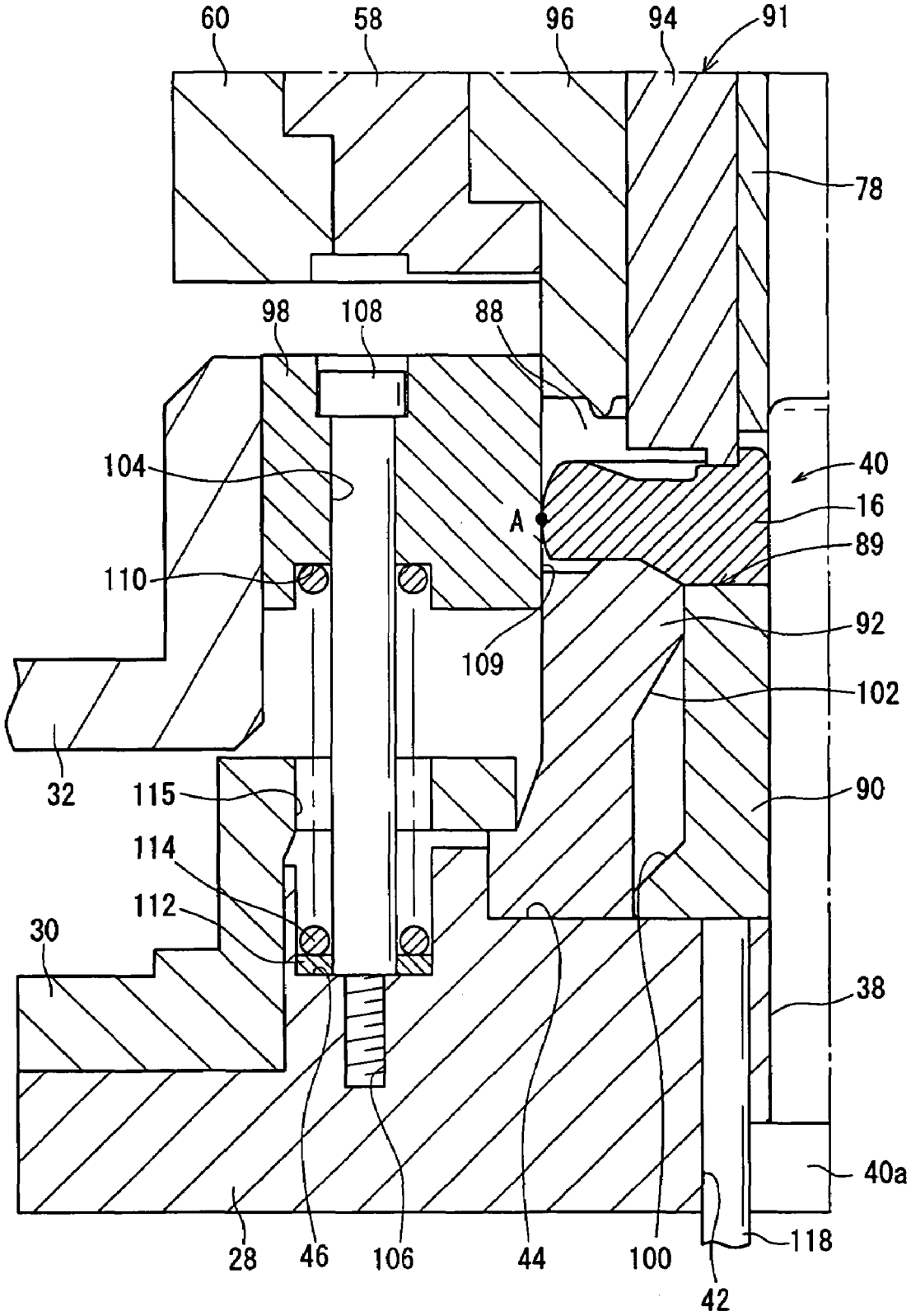
FIG. 4 is an enlarged fragmentary vertical cross-sectional view showing the manner in which the end of the first upper die is pressed into the workpiece in the forging apparatus shown in FIG. 3.

When the actuator 14 (see FIG. 1) is further displaced downwardly as shown in FIG. 4, the press 50 (see FIG. 1) presses the first upper die 94 to push its lower end into the workpiece 16, causing the material of the workpiece 16 to flow radially inwardly toward the guide shaft 40 and radially outwardly toward the lower die unit 89.

The material of the workpiece 16 also flows toward the inner circumferential surface 109 of the outer ring 98 until the inner circumferential surface 109 and the material of the workpiece 16 contact each other at a point A (see FIG. 4). At this time, the inner circumferential surface 109 of the outer ring 98 is pushed downwardly by the flowing material of the workpiece 16, whereupon the outer ring 98 is displaced downwardly against the forces of the springs 114.

Figure 5:
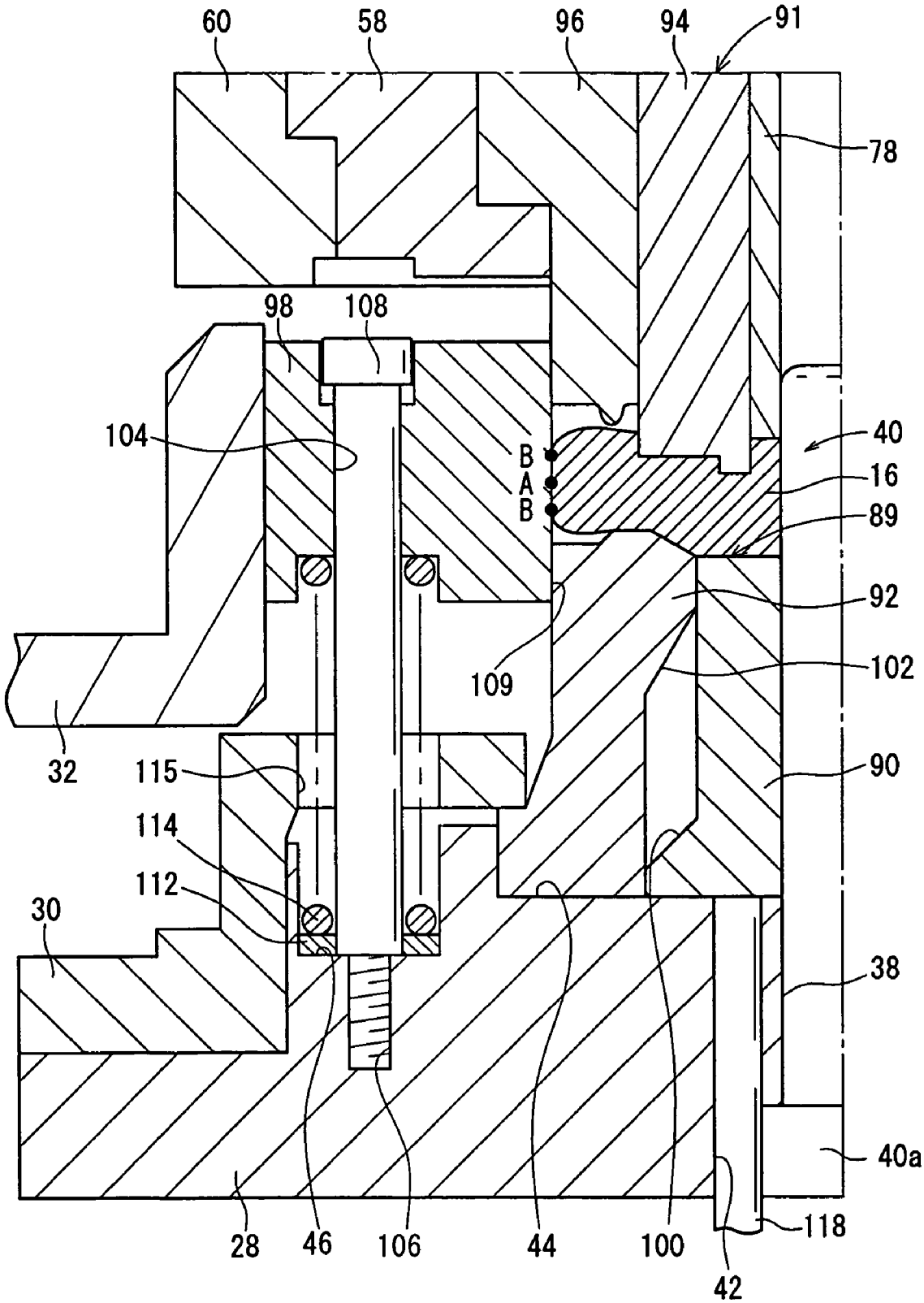
FIG. 5 is an enlarged fragmentary vertical cross-sectional view showing the manner in which the end of the first upper die is further pressed into the workpiece and the distal end of a piston is held against the upper surface of the workpiece in the forging apparatus shown in FIG. 4.

Then, when the actuator 14 (see FIG. 1) is further displaced downwardly as shown in FIG. 5, the lower end of the first upper die 94 is pushed into the upper surface of the workpiece 16 which has slightly been plastically deformed, causing the material of the workpiece 16 to flow toward the outer ring 98. As the material of the workpiece 16 flows, the outer circumferential surface of the workpiece 16 is brought into contact with the inner circumferential surface 109 of the outer ring 98 from the point A to two points B that are axially equally spaced from the point A. Therefore, the outer circumferential surface of the workpiece 16 is held flatwise in contact with the inner circumferential surface 109 of the outer ring 98 at the points A, B. Since the inner circumferential surface 109 of the outer ring 98 is further pushed downwardly by the flowing material of the workpiece 16, the outer ring 98 is further displaced downwardly against the forces of the springs 114.

Figure 6:
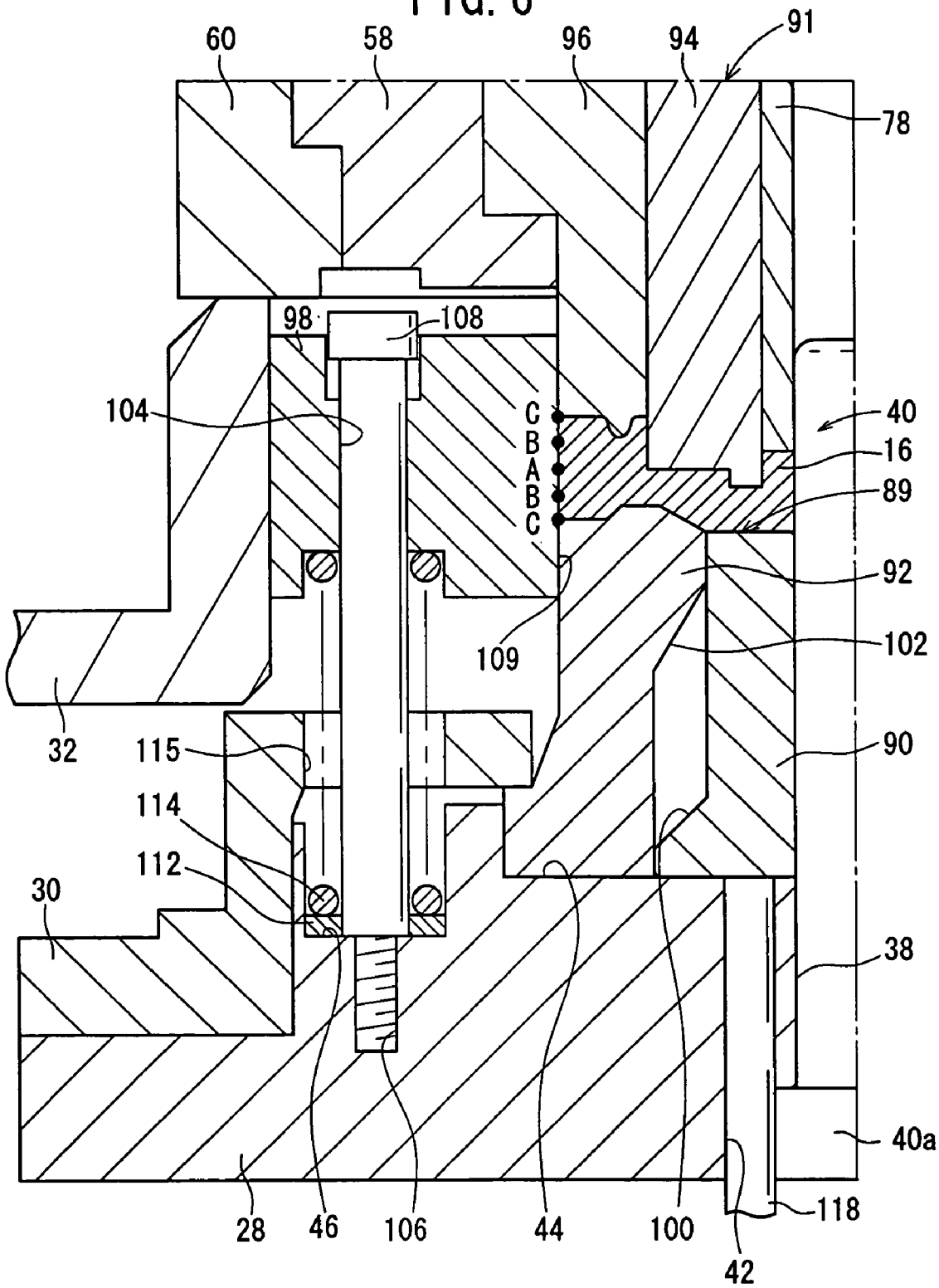
FIG. 6 is an enlarged fragmentary vertical cross-sectional view showing the manner in which the first upper die is further displaced into the workpiece and the workpiece is forged in the forging apparatus shown in FIG. 5.

Finally, when the actuator 14 (see FIG. 1) is further displaced downwardly to a preset terminal position as shown in FIG. 6, the lower end of the first upper die 94 is further pushed into the upper surface of the workpiece 16 which has been plastically deformed, and the distal end of the piston 78 is pressed against and pushes the upper surface of the workpiece 16 downwardly. Therefore, the material of the workpiece 16 flows along the upper surfaces of the first and second lower dies 90, 92 and also flows toward the outer ring 98.

As the material of the workpiece 16 flows, the outer circumferential surface of the workpiece 16 is further brought into contact with the inner circumferential surface 109 of the outer ring 98 from the points B to two points C that are axially equally spaced from the points B, respectively. As a result, the material of the workpiece 16 flows into a desired shape filling the die cavity 88 (see FIG. 4) that is closed by the lower surfaces of the first and second upper dies 94, 96, the upper surfaces of the first and second lower dies 90, 92, the inner circumferential surface 109 of the outer ring 98, and the guide shaft 40.

Because the inner circumferential surface 109 of the outer ring 98 is further pushed downwardly by the flowing material of the workpiece 16 that is pressed by the first and second upper dies 94, 96, the outer ring 98 is further displaced downwardly against the forces of the springs 114.

Inasmuch as the outer ring 98 is displaceable axially downwardly by the flow of the material of the workpiece 16 which contacts the inner circumferential surface 109 of the outer ring 98, frictional forces created between the workpiece 16 and the inner circumferential surface 109 of the outer ring 98 are reduced.

The forged workpiece 16 is removed from the die assembly 18 as follows. First, the second ejector pins 120 of the second shaft 68 have their lower distal ends held against the piston 78, holding the lower end of the piston 78 in contact with the upper end of the workpiece 16.

Figure 7:
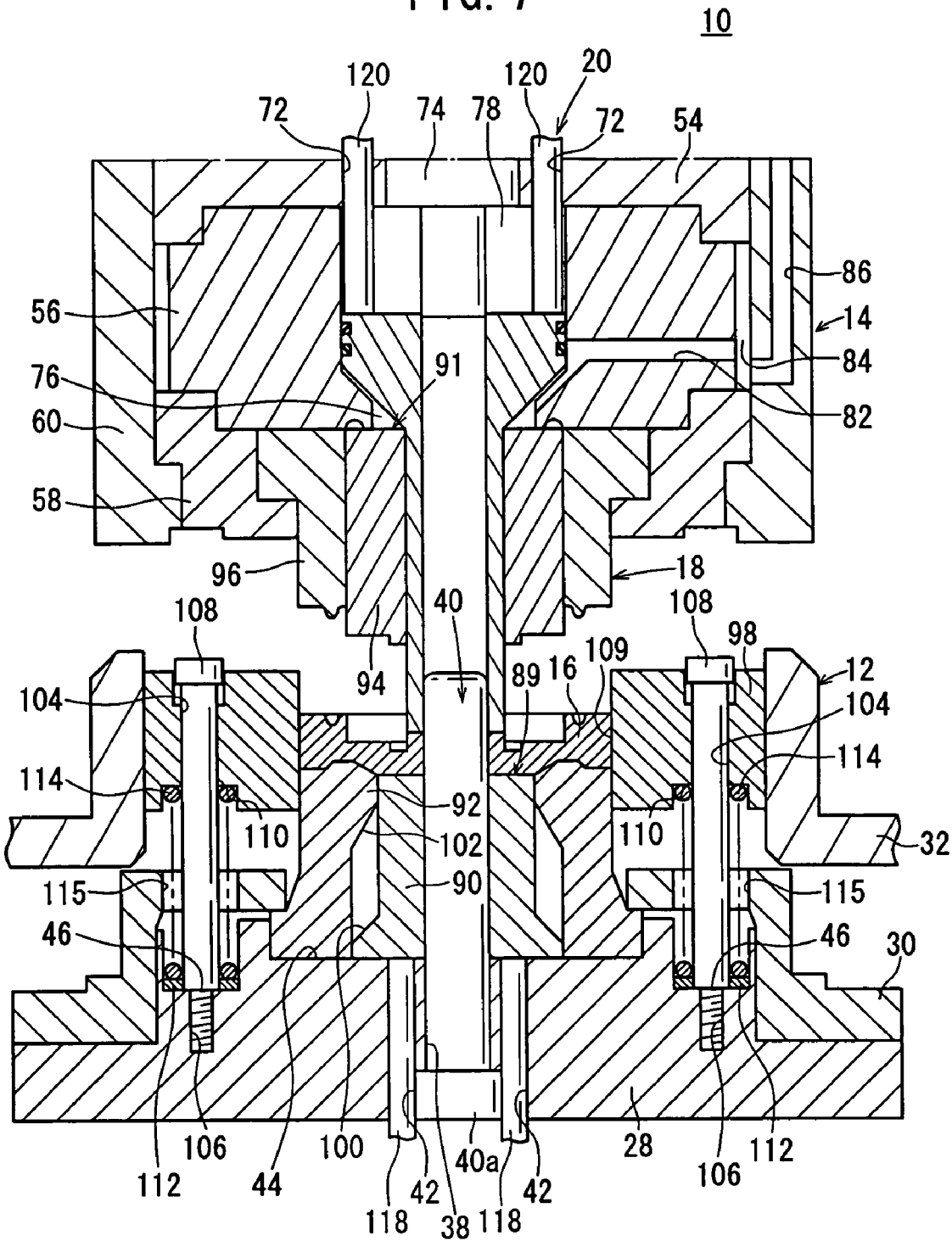
FIG. 7 is a vertical cross-sectional view showing the manner in which the first upper die and a second upper die are lifted away from the workpiece in the forging apparatus.

Then, as shown in FIG. 7, the cylinder chamber 76 which has been supplied with the fluid under pressure from the non-illustrated fluid pressure source is vented to the atmosphere, and the press 50 (see FIG. 1) is displaced upwardly to displace the first through third connectors 54, 56, 58, the joint 60, and the first and second upper dies 94, 96 upwardly in unison with each other. At this time, since the upper surface of the workpiece 16 is pressed by the lower end of the piston 78, the workpiece 16 is not displayed upwardly in unison with the first and second upper dies 94, 96 which are displayed upwardly. As a consequence, the workpiece 16 is spaced from the first and second upper dies 94, 96, and remains placed on the upper surfaces of the first and second lower dies 90, 92.

Figure 8:
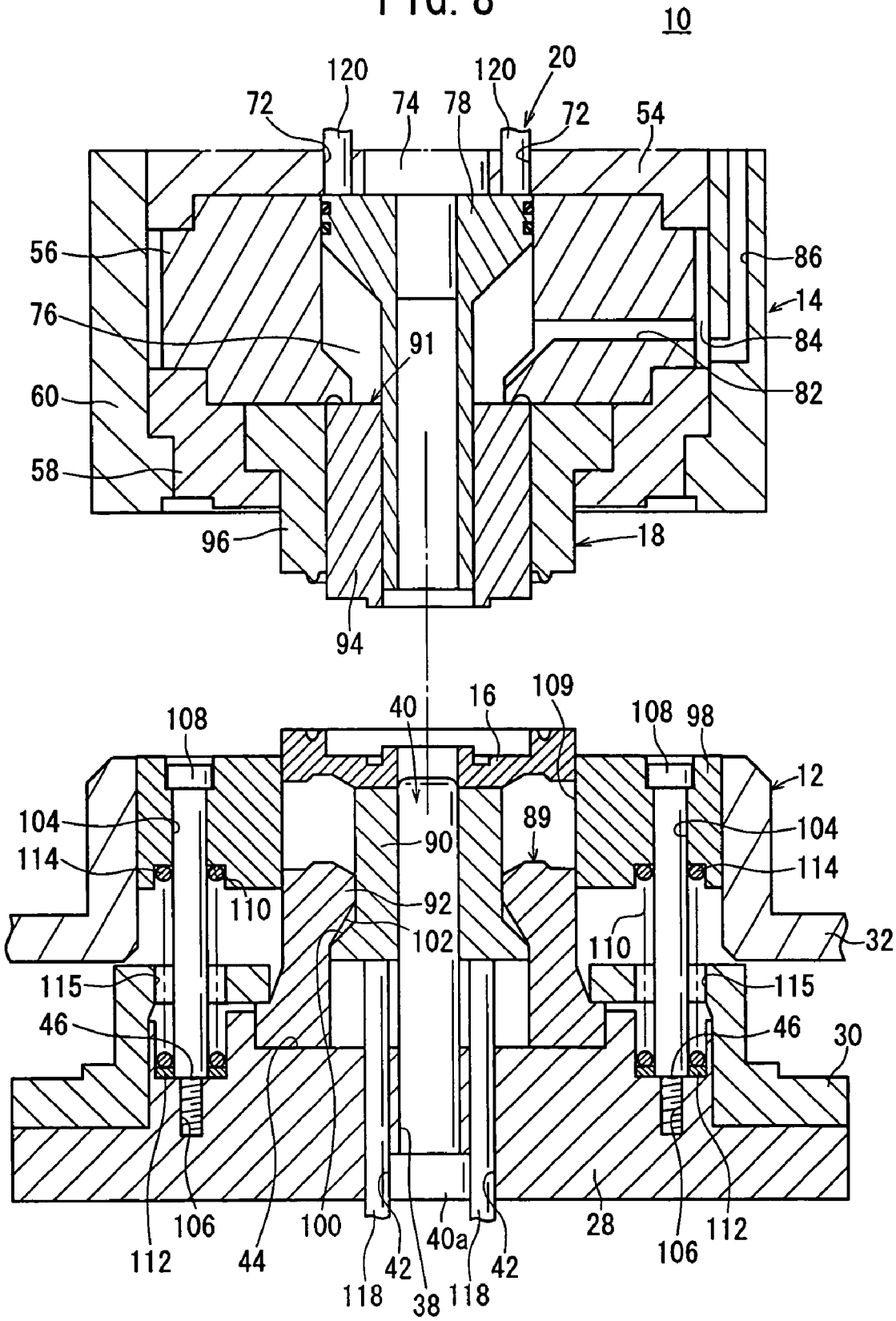
FIG. 8 is a vertical cross-sectional view showing the manner in which the workpiece is removed from a die assembly in the forging apparatus shown in FIG. 7.

Finally, as shown in FIG. 8, the second ejector pins 120 of the second shaft 68 (see FIG. 1) are displaced upwardly, and the cylinder chamber 76 is supplied again with the fluid under pressure, displacing the piston 78 upwardly. The distal end of the piston 78 is now spaced from the workpiece 16 and displaced upwardly. Then, the first shaft 36 (see FIG. 1) extending through the second base 28 is displaced upwardly to cause the first ejector pins 118 to displace the first lower die 90 upwardly along the outer circumferential surface of the guide shaft 40. As a result, the first lower die 90 with the workpiece 16 placed on the upper surface thereof is displaced upwardly, spacing the lower surface of the workpiece 16 from the upper surface of the second lower die 92 and also spacing the outer circumferential surface of the workpiece 16 from the inner circumferential surface 109 of the outer ring 98. When the first lower die 90 is displaced upwardly by being pressed by the first ejector pins 118, the first slanted surface 100 of the first lower die 90 is engaged by the second slanted surface 102 of the second lower die 92, preventing the first lower die 90 from being dislodged from the second lower die 92.

Consequently, the forged workpiece 16 can be released from the die assembly 18 by the workpiece ejecting mechanism 20. The workpiece 16 can thus easily be removed from the die assembly 18.

According to the present embodiment, as described above, the axially displaceable outer ring 98 is disposed between the lower die unit 89 and the second fixing member 32. When the workpiece 16 is forged by being pressed by the first and second upper dies 94, 96, the flowing material of the workpiece 16 is brought into contact with the inner circumferential surface 109 of the outer ring 98, and the outer ring 98 is displaced axially as the material of the workpiece 16 flows. Therefore, frictional forces created between the workpiece 16 and the inner circumferential surface 109 of the outer ring 98 when the workpiece 16 is forged are reduced.

Consequently, the workpiece 16 forged by the die assembly 18 can easily be removed from the die assembly 18 simply by the first and second ejector pins 118, 120 without the need for draft angles which would otherwise be provided on the inner circumferential surface 109 of the outer ring 98 and the outer circumferential surface of the guide shaft 40 along the direction in which the workpiece 16 is pressed.

As there is no need for draft angles on side surfaces of the workpiece 16 along the direction in which the workpiece 16 is pressed, the forged workpiece 16 is not required to be subsequently machined. Therefore, the process of manufacturing the workpiece 16 can be shortened, and the workpiece 16 can be manufactured at a reduced cost accordingly.

Since the workpiece 16 does not require draft angles thereon, the amount of material of the blank to be forged into the workpiece 16 is smaller than if the workpiece 16 has draft angles thereon, and the workpiece 16 can be manufactured at a reduced cost accordingly.

If the guide pins 108 for guiding the outer ring 98 are positioned more closely to the workpiece 16, the outer ring 98 can be displaced axially with higher accuracy as the material of the workpiece 16 flows.

Although a certain preferred embodiment of the present invention has been shown and described in detail, it should be understood that various changes and modifications may be made therein without departing from the scope of the appended claims.

What is claimed is:

1. A forging apparatus for pressing a blank placed in a die cavity into a workpiece free from providing a draft angle on an inner surface of a die, said inner surface being parallel relative to said workpiece and a direction in which said blank is pressed, and said forging apparatus removing said workpiece from said die, comprising:

an actuator;

a first die unit displaceable along an axis by said actuator;

a second die unit disposed in a body at a position confronting said first die unit; and a displacement member disposed between said first die unit and said second die unit for displacement along said axis, said displacement member having an inner wall surface facing said first die unit and said second die unit and extending parallel to said axis;

wherein said displacement member is separate from said first die unit and said second die unit, and displaced axially downward in union with said workpiece by a flowing material of said workpiece contacting said inner wall surface of said displacement member under pressure of said first die unit and said second die unit.

2. A forging apparatus according to claim 1, further comprising a guide pin connected to said body, said displacement member being supported by said guide pin for displacement along said axis while being guided by said guide pin.

3. A forging apparatus according to claim 2, further comprising a spring interposed between said displacement member and said body, said displacement member being normally biased to move toward said actuator by said spring.

4. A forging apparatus according to claim 3, wherein said displacement member is displaceable along outer circumferential surfaces of said first die unit and said second die unit with said inner wall surface being held against said outer circumferential surfaces.

5. A forging apparatus according to claim 1, wherein said body has a cylinder chamber for being supplied with a fluid under pressure and a piston displaceable along said axis in said cylinder chamber under the pressure of the fluid supplied to said cylinder chamber, said piston being displaceable in unison with said first die unit by said actuator.

6. A forging apparatus according to claim 1, wherein said body has a workpiece removing mechanism for removing said workpiece from said first die unit and said second die unit.

7. A forging apparatus according to claim 6, wherein said workpiece removing mechanism comprises:

a first shaft for pressing said second die unit toward said workpiece; and a second shaft for pressing said piston toward said workpiece.

8. A forging apparatus according to claim 1, wherein said second die unit comprises:

a first die displaceable along said axis; and a second die disposed around said first die and fixed to said body, said first die having a first engaging surface on an outer circumferential surface thereof, said second die having a second engaging surface on an inner circumferential surface thereof, wherein said first engaging surface and said second engaging surface are brought into engagement with each other when said first die is displaced.

9. A forging apparatus according to claim 1, further comprising a guide shaft fixed to said body and extending substantially centrally through said first die unit and said second die unit, said first die unit and said second die unit being displaceable while being guided by said guide shaft.

10. A forging apparatus according to claim 1, wherein said first die unit, said second die unit, and said displacement member jointly define said die cavity, by which said workpiece is forged.

11. A forging apparatus for pressing a blank placed in a die cavity into a workpiece, comprising:

an actuator;

a first die unit displaceable along an axis by said actuator;

a second die unit disposed in a body at a position confronting said first die unit;

a displacement member disposed between said first die unit and said second die unit for displacement along said axis, said displacement member having an inner wall surface facing said first die unit and said second die unit and extending parallel to said axis; and a guide shaft fixed to said body and extending substantially centrally through said first die unit and said second die unit, said first die unit and said second die unit being displaceable while being guided by said guide shaft, wherein said displacement member is separate from said first die unit and said second die unit.

12. A forging apparatus according to claim 11, further comprising a guide pin connected to said body, said displacement member being supported by said guide pin for displacement along said axis while being guided by said guide pin.

13. A forging apparatus according to claim 12, further comprising a spring interposed between said displacement member and said body, said displacement member being normally biased to move toward said actuator by said spring.

14. A forging apparatus according to claim 13, wherein said displacement member is displaceable along outer circumferential surfaces of said first die unit and said second die unit with said inner wall surface being held against said outer circumferential surfaces.

15. A forging apparatus according to claim 11, wherein said body has a cylinder chamber for being supplied with a fluid under pressure and a piston displaceable along said axis in said cylinder chamber under the pressure of the fluid supplied to said cylinder chamber, said piston being displaceable in unison with said first die unit by said actuator.

16. A forging apparatus according to claim 11, wherein said body has a workpiece removing mechanism for removing said workpiece from said first die unit and said second die unit.

17. A forging apparatus according to claim 16, wherein said workpiece removing mechanism comprises:

a first shaft for pressing said second die unit toward said workpiece; and a second shaft for pressing said piston toward said workpiece.

18. A forging apparatus according to claim 11, wherein said second die unit comprises:

a first die displaceable along said axis; and a second die disposed around said first die and fixed to said body, said first die having a first engaging surface on an outer circumferential surface thereof, said second die having a second engaging surface on an inner circumferential surface thereof, wherein said first engaging surface and said second engaging surface are brought into engagement with each other when said first die is displaced.

19. A forging apparatus according to claim 11, wherein said first die unit, said second die unit, and said displacement member jointly define said die cavity, by which said workpiece is forged.

* * * * *